United States Patent [19]

Hammett

[11] 4,372,395

[45] Feb. 8, 1983

[54] STAB WATER SUPPLY SYSTEM

[75] Inventor: Dillard S. Hammett, Dallas, Tex.

[73] Assignee: SEDCO, Inc., Dallas, Tex.

[21] Appl. No.: 319,725

[22] Filed: Nov. 9, 1981

Related U.S. Application Data

[63] Continuation of Ser. No. 89,541, Oct. 29, 1979, abandoned.

[51] Int. Cl.[3] ..... A62C 13/24

[52] U.S. Cl. ..... 169/69; 169/62; 285/3

[58] Field of Search ..... 169/69, 62, 70, 54, 169/16, 46, 47; 285/2, 3, 4, 18; 403/2; 244/135 A; 166/79, 90

[56] References Cited

U.S. PATENT DOCUMENTS 2,576,143 11/1951 Rochet ..... 169/70

4,206,938 6/1980 Bartell ..... 285/2

*Primary Examiner*—Joseph J. Rolla

*Assistant Examiner*—Kenneth Noland

*Attorney, Agent, or Firm*—Hubbard, Thurman, Turner & Tucker

[57] ABSTRACT

Apparatus and method for fire suppression on offshore oil platforms including a stab receptacle on an outer surface of a platform connected to a fluid distribution system within the platform for distributing fire suppressing fluid to selected locations, a stab carrying a fluid conduit from a self-propelled service vessel, with the stab being in turn supported on a boom extending from the service vessel, a pumping system on the service vessel for supplying fire suppressing fluid through the conduit to the stab and thereby to the preselected locations. The service vessel is preferably a semi-submersible and includes a system for dynamic positioning of the vessel such as side thrusters in addition to a main propulsion unit.

7 Claims, 9 Drawing Figures

STAB WATER SUPPLY SYSTEM

This is a continuation of application Ser. No. 06/089,541, filed Oct. 29, 1979 now abandoned.

BACKGROUND OF THE INVENTION

This invention relates to fire suppression systems for use with offshore oil platforms and in particular to a fluid conducting stab and stab receptacle system for use in conducting a supply of fire suppressing fluid from a service vessel to a platform.

Rising prices of hydrocarbon energy sources have made the offshore production of hydrocarbons economically attractive. Offshore production accounts for a large percentage of the worldwide oil production and that percentage is expected to increase in the future. The technical problems of providing oil drilling and production platforms in waters approaching a thousand feet of depth have been rapidly overcome. The cost of building the necessary structures usually can be justified only when a large number of wells are drilled from a single platform. The term "platform" is in fact somewhat misleading since the modern offshore oil platforms often more closely resemble a large multistory factory and hotel complex. While the platforms have become quite massive, space is still at a premium when it is considered that typically ten to fifty wells are drilled from each platform and large quantities of equipment must be provided near the wellheads during drilling and production. The wellhead locations are therefor usually surrounded by the equipment which, in turn, is housed in numerous compartments into which the multistory platforms are divided.

While it may appear that the simplest manner of fighting fires on a platform is to provide the fire fighting equipment on the platform itself, this arrangement is not practical for several reasons. In case of blowout, it is essential that all power on the platform be shut off immediately to avoid any sparks which might ignite escaping gas. It an explosion or fire has already occurred, damage to the platform is usually so extensive that it would be impossible to keep a power system in operation. Even if some power were available to operate a fire fighting system capable of pumping sufficient quantities of fire fighting fluids to the necessary locations, there would be no manpower available to operate the systems. When a blowout occurs, and in any case when a resulting fire occurs, the first concern is to evacuate the platform to avoid loss of life. As a result, the only means of fighting fires on offshore oil platforms has been from a vessel such as a fire boat or an auxiliary platform set up adjacent to the burning platform. In case of a blowout and fire at a wellhead, it has been found to be quite difficult to supply fire suppressing fluids, such as water or foam, to the location of the fire. That is, while typical fire boats have the capacity to pump large quantities of water and direct it toward a platform, the platform structure itself deflects essentially all of the water and prevents it from reaching a wellhead fire.

Another problem encountered in wellhead fires is loss of structural integrity of the platform itself. The most critical structural elements of the platform are those which connect the platform to the top of the supporting legs. The wells are drilled through the supporting legs so that the wellheads are necessarily positioned above the legs and above the critical structural points. In the case of a blowout and fire, hydrocarbon fluids may flow down through the structure and into or around the supporting legs while burning thereby heating the critical structural elements. If these points in the structure are weakened sufficiently by the heat, the entire platform may collapse with obvious disastrous results. It is therefore very important when fighting platform fires to pump large quantities of water to the structural elements at the point of interconnection with the supporting legs. But it is difficult to direct water from conventional fireboats to this part of the structure since the platform itself covers and surrounds this part of the structure. The fire fighting ships must typically direct the water upward to this lower portion of the platform structure from a fairly close and dangerous position and even then may only be able to cool one side of the support structure since the leg itself shields the opposite side from the spray of cooling water.

Thus, a system for directing large quantities of water to the platform structure at the junction of the structure and supporting legs would be highly desirable to avoid total loss of the structure in case of blowout and fire.

SUMMARY OF THE INVENTION

Accordingly, an object of the present invention is to provide apparatus and a method for efficiently directing large quantities of fire fighting fluids to critical locations on offshore oil platforms.

Another object of the present invention is to provide a fluid distribution system on an offshore platform including means for receiving the fire fighting fluid from an external source and means for directing the fluid to preselected locations on the platform.

Another object of the present invention is to provide apparatus carried on a self-propelled vessel for coupling fire suppressing fluids to a fluid distribution system on an offshore oil platform.

A system according to the present invention includes a stab receptacle mounted on an external wall of an offshore oil platform and connected to a fluid distribution system built into the platform having water directing nozzles or outlets positioned to direct fire suppressing fluids at critical locations on the platform. The system also includes a stab assembly carried on a crane boom on a service vessel and fluid conduit means coupling the stab assembly to fluid pumping means on the service vessel. The fire fighting method of the invention includes the use of the service vessel and crane boom to guide the stab assembly to the stab receptacle on the platform thereby completing a fluid path from pumping equipment on the service vessel to the distribution system on the platform so that large quantities of fire suppressing fluids may be efficiently and effectively pumped to critical locations on the platform.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENTS

Figure 1:
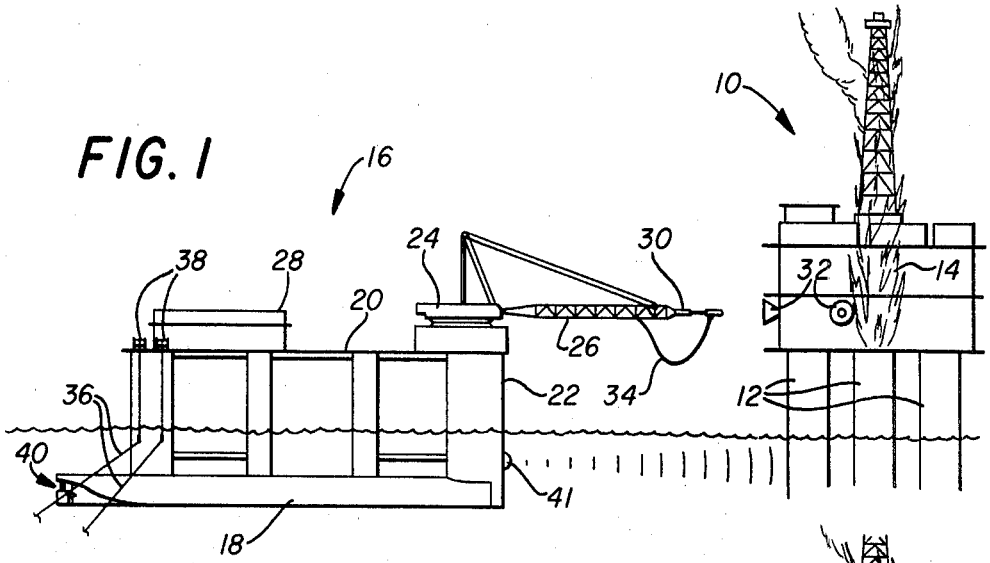
FIGS. 1, 2 and 3 illustrate sequentially the connection of a stab assembly carried on a service vessel to a receptacle on an offshore oil platform.
Figure 2:
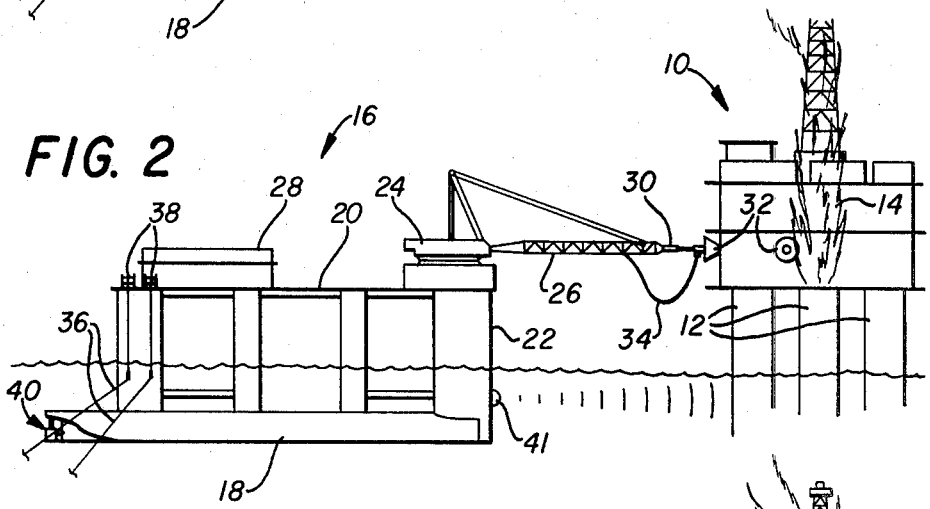
Figure 3:
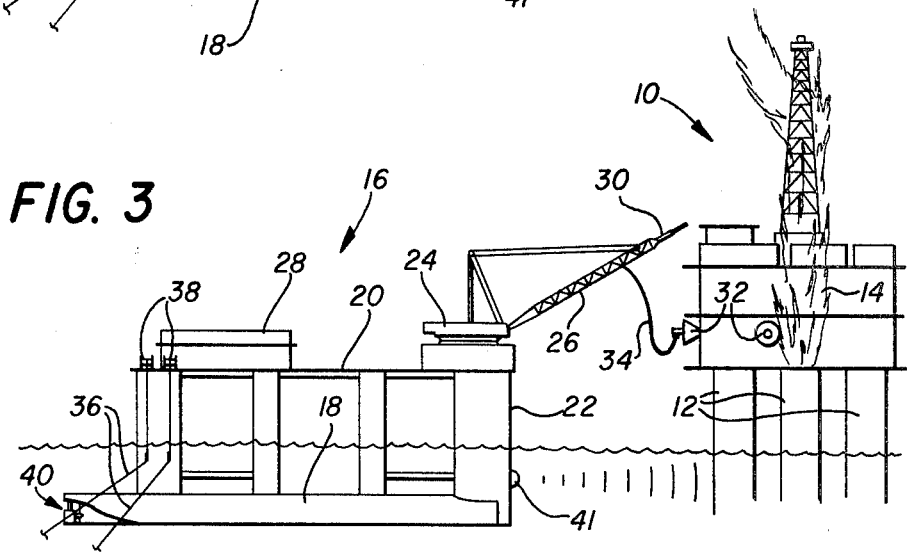

The general apparatus and method of the present invention is illustrated sequentially in FIGS. 1 through 3. A simplified illustration of an offshore oil platform is illustrated at 10 supported on legs 12. Flames 14 indicate a blowout and fire has occurred in a well drilled through one of the legs 12. As noted above, in case of such a fire, all systems on platform 10 are shutdown and all personnel are evacuated so that fire fighting must be done from another work platform such as a semi-submersible service vessel 16. Vessel 16 is of generally conventional construction having an overall length of about 450 feet, a width of about 250 feet and a height from lower hull 18 to deck 20 of about 150 feet.

Vessel 16 is preferably modified in that the hulls 18 do not extend beyond the forward vertical column 22. This modification allows the vessel 16 to approach an offshore platform very closely without fear of collision between the lower hull 18 and a platform leg 12. A crane 24 of the 250 to the 350 ton class is carried on the forward end of vessel 16 and has a boom 26 which may be extended from the forward end of vessel 16 to provide a very long and safe reach of up to 300 feet from the forward end of the vessel. Vessel 16 also preferably carries a modular arrangement 28 having crew quarters, infirmary and fire fighting equipment including pumps on the work deck 20.

Vessel 16 includes a number of elements which together allow the vessel to be maintained very accurately at a selected position relative to platform 10. This includes at least a pair of mooring lines 36 connected to retrieval means, or winches 38. A main propulsion system 40 is provided for moving the vessel to its work location and also for use in dynamic positioning. Side thrusters (not illustrated) are also preferably included on vessel 16 for dynamic positioning. In addition, a sonar unit 41 is provided for determining the distance between the forward end of the vessel 16 and the platform 10. With the output from sonar unit 41, or some other distance measuring equipment, the positioning of vessel 16 may be automated. This positioning equipment is employed to bring the vessel 16 into close proximity with the platform 10 as illustrated in FIGS. 1 and 2, without danger of collision.

Once vessel 16 has been brought into position as illustrated in FIG. 2, fire fighting equipment on vessel 16 is coupled to critical locations on platform 10 by means of a stab assembly 30 carried on the end of boom 26 and a receptacle arrangement 32 carried on platform 10. A flexible hose 34 extends from stab assembly 30 to pumping equipment and a source of fire suppressant fluid on work deck 20. Assembly 30 includes positioning apparatus for aligning the stab 30 with the receptacle 32 and for inserting the stab into a locked position within a receptacle socket as illustrated in FIG. 2. After the stab has been locked into receptacle 32, the positioning apparatus is pulled free from the stab itself leaving the stab locked to receptacle 32, as in FIG. 3. The crane boom 26 may then be moved away from the platform 10 and, if desired, vessel 16 may move away within the constraints imposed by the length of hose 34. Hose 34 may be released from crane boom 26 so that crane 24 may be used for other operations including the connection of other stabs into other receptacles on the platform 10.

While vessel 16 has been illustrated as a conventional semi-submersible, other types of vessels may also be used. A conventional drillship or service vessel could carry the necessary equipment and crane 24 and could possibly reach the scene of a fire more quickly. In appropriate circumstances, the equipment may be positioned on an adjacent platform. The semi-submersible is preferred since it provides a large stable work platform and can be moved fairly rapidly.

Figures 4, 5, 6:
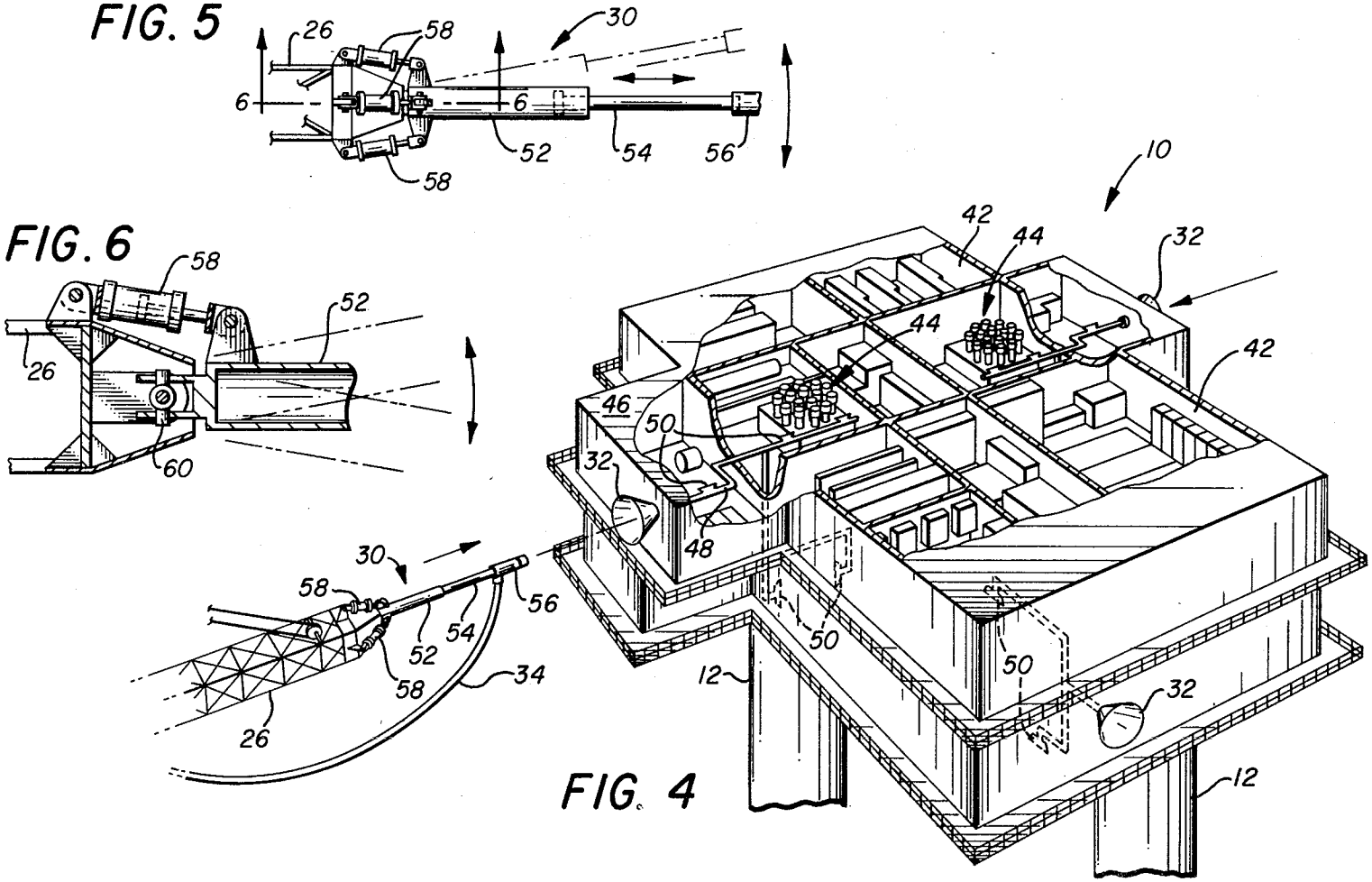
FIG. 4 is a more detailed and partially broken away illustration of an offshore oil platform and a boom carried stab assembly.
FIGS. 5 and 6 illustrate the details of the stab assembly control mechanism carried on the end of a crane boom.

With reference now to FIG. 4, details of the present invention are illustrated in a broken-away view of lower levels of platform 10 and an end of boom 26 carrying the stab assembly 30. Modern platforms 10 generally are constructed in the form of a number of compartments 42 each housing and protecting various types of equipment. Wellheads 44 are located within compartments directly over legs 12 through which the wells are drilled. As illustrated, each of the wellhead compartments is completely surrounded by other cmpartments filled with necessary equipment which block access to the wellhead site. One or more of the stab receptacles 32 are provided in outer walls of, for example, a compartment 46. A piping system 48 connects the receptacle 32 to a number of nozzles 50 which are positioned to direct fire suppressing fluid on critical areas such as the wellhead compartments and the steel structure connecting platform 10 to legs 12.

The stab assembly 30 carried on boom 26 includes a control arm 52, an extension arm 54 and the actual stab element 56, all pivotally carried on the end of boom 26. Hydraulic cylinders 58 control the position of the assembly 30 to place it in alignment with the receptacle 32 so that extension arm 54 may drive stab 56 into its locking position within the receptacle. The flexible hose 34 is connected to stab 56 to conduct fluid from the vessel 16.

FIGS. 5 and 6 provide two views of the directional control arrangements provided in stab assembly 30. As illustrated, the control arm 52 comprises an actuator in the form of a hydraulic cylinder pivotally connected to the end of boom 26 by a universal joint 60. The small hydraulic cylinders 58 control the horizontal and vertical directions of the control arm 52 as indicated in FIGS. 5 and 6, respectively. The extension arm 54 is integral with a piston carried within cylinder 52 and carries on its extended end the stab 56.

Figure 7:
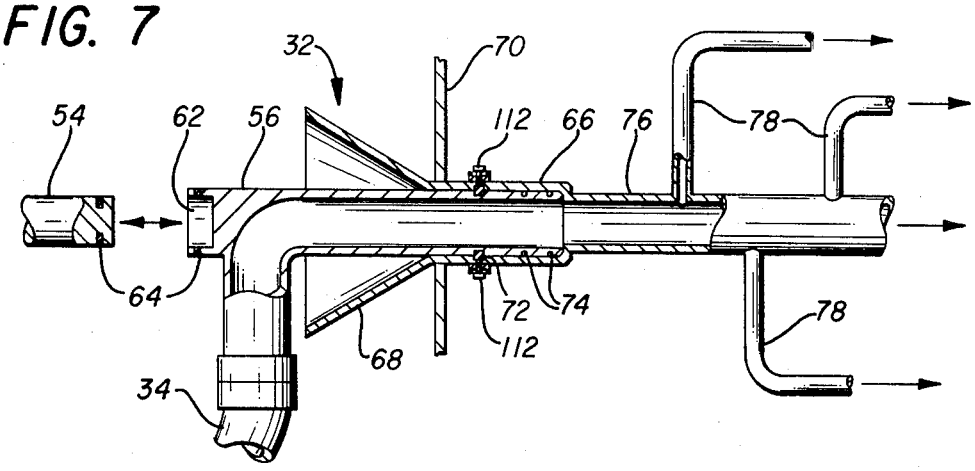
FIGS. 7 and 8 are cross sectional illustrations of the interconnection of two embodiments of stab assemblies and receptacles according to the present invention.

Reference to FIG. 7 provides more details of the method of connecting stab 56 to the extension arm 54. In particular, a recess or socket 62 is provided in stab 56 for receiving the end of extension arm 54. In addition, shear pins 64 are provided in the end of extension arm 54 and in stab 56 for connecting the stab to the extension arm. But when the stab 56 is locked into receptacle 32 and extension arm 54 is retracted, the extension arm is separated from the stab 56 by shearing off the pins.

Further reference to FIG. 7 shows that the stab receptacle 32 comprises a cylindrical socket section 66 and a conical guide way 68. The cylindrical section 66 is carried mostly inside of compartment 46 and is attached to an outer wall 70 of the compartment. A locking groove arrangement 72 is provided on an inner wall of cylindrical section 66 for receiving a locking ring carried by the stab 56, further details of which are explained with reference to FIG. 9 below. Rubber gaskets 74 may be provided on the outer surface of stab 56 to provide a watertight seal between the receptacle 32 and stab 56. In the FIG. 7 embodiment, a single main conduit 76 is coupled to the inner side of receptacle 32 to direct water to desired locations. Branch conduits 78 may be provided leading from main conduit 76 to the various locations where fire suppressing fluid may be required. In a preferred embodiment, the hose 34 leading from vessel 16 to the stab 56 has an outer diameter of twelve inches. Stab 56 itself also has an outer diameter of twelve inches and provides a fairly close fit with the inner surface of cylindrical portion 66 of receptacle 32. In the preferred form, the largest diameter portion of conical guide 68 is about eight feet. The conduit 76 preferably has an outer diameter of at least ten inches. These pipe sizes are intended to carry the large quantities of fire suppressing fluids required, typically ten to forty thousand gallons per minute.

Figure 8:
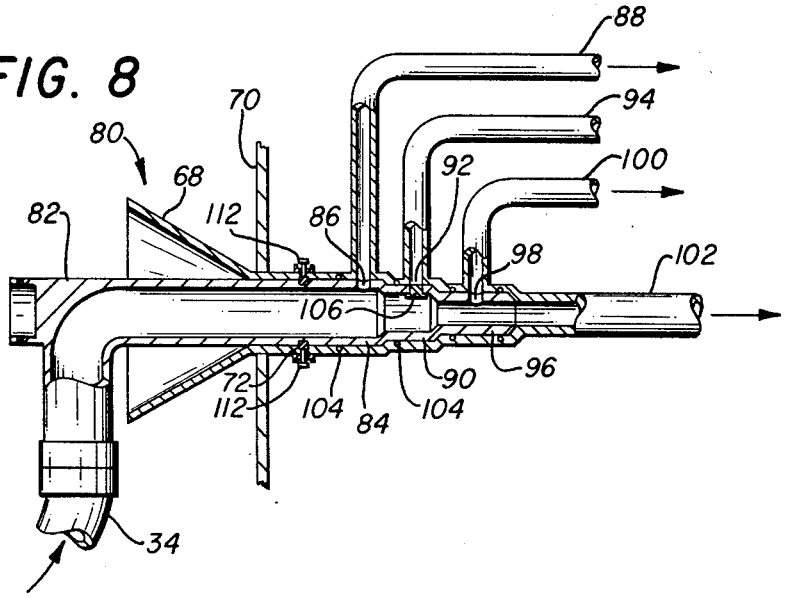

With reference to FIG. 8, a modified stab and receptacle arrangement is illustrated which allows for selection of which areas are to receive fire suppressing fluid. Portions of a receptacle 80 and stab 82 external to a wall 70 may be identical to those portions illustrated in FIG. 7. The locking ring arrangements 72 inside of wall 70 may also be identical. But the cylindrical socket portions of stab 82 and receptacle 80 step down to three different diameters. A first diameter portion 84 of stab 82 may be of the full twelve inch diameter but it has a side port 86 in communication with a branch conduit 88 leading to a particular fire control area. Likewise, a second and smaller diameter portion 90 of stab 82 has a side port 92 in communication with a second branch conduit 94. A third and yet smaller diameter section 96 of stab 82 has a third side port 98 in communication with a branch conduit 100. A main conduit 102 is in communication with the central bore of stab 82. The internal portion of receptacle 80 is stepped down to match the configuration of stab 82. A number of rubber seals 104 are provided between stab 82 and receptacle 80 so that each of the branch conduits may be isolated from the others.

The FIG. 8 embodiment provides a method of selecting areas to which the fluid will be conducted. In this way, it would be possible to provide a small number of receptacles 80 in the best locations for access from service vessel 16. Branch conduits such as conduits 88, 94 and 100 may then be provided leading to all of the possible critical locations on the platform. In case of a blowout and fire, it is likely that fire suppressing fluids will be needed only in certain of the critical areas depending on the location of the fire. If the location of the fire, and therefore the critical danger points on the platform, can be located prior to linking the service vessel 16 to the platform by means of the stab 82, the stab may be modified to conduct fluid only to the critical locations. This may be done simply by providing plugs, such as plug 106 which may be inserted into the selected port in stab 82 prior to connection of the stab to the receptacle. This arrangement can provide the most efficient use of fire fighting equipment which is available.

An alternate method of directing fluid only to critical areas or a particular fire location is to simply provide a plurality of receptacles as illustrated in FIG. 7. For example, a fire at a particular wellhead location can be anticipated to endanger only certain portions of the platform and separate receptacle 32 can be arranged to conduct fluid to each of those critical locations corresponding to the particular fire condition.

Figure 9:
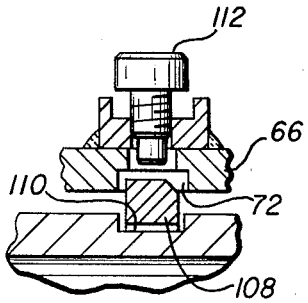
FIG. 9 is a detailed cross sectional illustration of a split ring means for securing a stab assembly to a receptacle.

References to FIG. 9 provides a more detailed illustration of the locking ring arrangement which holds the stab 56 or 82 into the corresponding receptacle socket once it has been driven into place by the service vessel supported equipment. A groove 72 is provided on the inner surface of cylindrical section 66 of the receptacle 32. A split or other form of expanding ring 108 is carried in another groove 110 on the outer surface of the stab 56. Upon insertion of the stab into the guide 68, the ring 108 is compressed until the stab is fully inserted in the socket at which point it expands into groove 72 locking the stab to the receptacle. A cap screw 112 is provided on the outer surface of cylindrical sections 66 for driving split ring 108 from groove 72 to release the stab 56 from receptacle 32.

The use of the present invention is well illustrated in FIGS. 1 through 3. Upon the occurrence of a fire 14 at an offshore platform 10, the vessel 16 is brought to the location as rapidly as possible. During the trip to the location, the stab assembly 30 and conduit 34 are assembled on the boom 26 of crane 24. Upon arrival on location, the vessel 16 drops anchors at an appropriate distance from the platform and uses mooring lines 36 and its propulsion units to approach platform 10 in a closely controlled manner. Before reaching the location, the crew of vessel 16 will have been informed of the location of fire 14 on platform 10 and can therefore determine the proper approach direction and the appropriate receptacles 32 which may be used to direct the fire suppressing fluids to the critical locations. If the FIG. 8 embodiment is employed, the appropriate side port of ports will be plugged in stab 82 prior to installation on boom 26. The boom and stab control apparatus are then brought into alignment with the proper receptacle 32 and the stab is locked into place. As shown in FIG. 3, the control apparatus and boom are then disengaged from the stab but the pumping of fire suppressing fluid may begin immediately.

While the above description is made assuming that the fire danger involves an actual blowout and wellhead fire, this fire control apparatus may be used in other cases also. For example, a fire may occur in an engine room or any other equipment compartment or module on the platform. It may be desired in such a case to merely flood the appropriate compartment with fire suppressing foam rather than pumping the large quantities of water normally used to cool the structure in a wellhead area in case of a blowout. The present equipment is equally adaptable to use with fire suppressing foam or other fluids in place of water. Even in the case of a wellhead fire, it may be desirable to flood compartments surrounding the fire location with the foam by use of one stab receptacle while a second is used to flood the actual fire location with, for example, water.

While the present invention has been shown and illustrated in terms of particular apparatus and method of use, it is apparent that various modifications can be made within the scope of the present invention as defined by the appended claims.

What is claimed is:

1. A fire suppression system for use in controlling fires occurring on an offshore oil platform comprising:

pipe means on said platform for distributing fire suppressing fluid to locations throughout said platform;

at least one inlet for said pipe means which is accessible from the exterior of said platform;

a service vessel;

means for maintaining said service vessel at a predetermined station adjacent said platform;

a stab connector carried by said service vessel and adapted for connection to said inlet to establish a flow path for fire suppressing fluid from said service vessel to said pipe means;

a boom mounted on said service vessel and extendable therefrom towards said platform;

maneuverable support means at the outboard end of said boom supporting said stab connector;

control means on said service vessel at a position remote from said outboard end of said boom for operating said maneuverable support means whereby said stab connector can be inserted into said inlet; and means on said service vessel for supplying a fire suppressing fluid under pressure to said stab connector, said means including a pump.

2. The system of claim 1 wherein said controlling means comprises:

a control arm pivotally connected at its inboard end to the outboard end of the boom; and an extension arm reciprocally mounted to said control arm and adapted at its outboard end to support said stab connector.

3. The system of claim 1 wherein said inlet has a plurality of ports, each positioned so as to be aligned with an associated port in said stab connector when said stab connection is seated in said inlet.

4. A system according to claim 1 wherein the maneuverable support means includes a plurality of extendable actuators, responsive to signals from said control means, to maneuver a control arm extending from the outboard end of said boom, on the outer end of which control arm said stab connector is detachably mounted.

5. A fire suppression system for use in controlling fires occurring on an offshore oil platform comprising:

pipe means on said platform for distributing fire suppressing fluid to locations throughout said platform;

at least one inlet for said pipe means which is accessible from the exterior of said platform;

a service vessel;

means for maintaining said service vessel at a predetermined station adjacent said platform;

a stab connector adapted for connection to said inlet to establish a flow path for fire suppressing fluid from said service vessel to said pipe means said stab connector being mounted on a boom carried by said service vessel whereby, said stab connector can be remotely maneuvered into said at least one inlet;

said stab connector including a tubular member having a fluid inlet, a fluid outlet comprising a plurality of ports and means for selectively closing at least one of said ports.

6. The system of claim 5 wherein said closing means comprises a plug adapted to fit in one of said plurality of ports for blocking-said port.

7. A method of suppressing fires on an offshore oil platform comprising the steps of:

maneuvering a service vessel into a position proximate said platform, said vessel including a boom extendable thereform towards said platform;

attaching a stab connector to said boom at the outboard end thereof said stab connector having a plurality of discharge ports therein;

maneuvering said stab connector by means provided on outboard end of said boom and inserting said stab into an inlet mounted on said platform while substantially maintaining the position of said vessel with respect to said platform;

pumping a fire suppressing fluid through said stab connector into said inlet;

distributing said fluid from said inlet to at least one preselected location on said platform; and selecting the location for fluid distribution by blocking at least one of said ports in said stab.

* * * * *